US008555786B2

(12) United States Patent
Ganz

(10) Patent No.: US 8,555,786 B2
(45) Date of Patent: Oct. 15, 2013

(54) MACHINE AND METHOD FOR RENOVATING A TRACK

(75) Inventor: Jörg Ganz, Etoy (CH)

(73) Assignee: Matisa Materiel Industriel SA, Crissier-Lausanne (CH)

( * ) Notice: Subject to any disclaimer, the term of this patent is extended or adjusted under 35 U.S.C. 154(b) by 182 days.

(21) Appl. No.: 13/140,093

(22) PCT Filed: Dec. 14, 2009

(86) PCT No.: PCT/EP2009/008917

§ 371 (c)(1),
(2), (4) Date: Oct. 13, 2011

(87) PCT Pub. No.: WO2010/072346

PCT Pub. Date: Jul. 1, 2010

(65) Prior Publication Data

US 2012/0111221 A1 May 10, 2012

(30) Foreign Application Priority Data

Dec. 16, 2008 (CH) ..... 1974/08

(51) Int. Cl.
*E01B 27/02* (2006.01)
*E01B 27/04* (2006.01)

(52) U.S. Cl.
USPC ..... 104/7.3; 171/16; 37/104

(58) Field of Classification Search
USPC ..... 104/2, 6, 7.1, 7.2, 7.3; 171/16; 37/104, 37/105
See application file for complete search history.

(56) References Cited

U.S. PATENT DOCUMENTS

| | | | | | |
|---|---|---|---|---|---|
| 2,886,904 | A * | 5/1959 | Kershaw | 37/104 |
| 3,054,459 | A * | 9/1962 | Scheuchzer | 171/16 |
| 4,342,165 | A * | 8/1982 | Theurer et al. | 37/104 |
| 4,640,364 | A * | 2/1987 | Theurer | 171/16 |
| 5,456,180 | A * | 10/1995 | Theurer et al. | 104/2 |
| 5,479,725 | A * | 1/1996 | Theurer et al. | 37/104 |
| 6,474,241 | B2 | 11/2002 | Theurer et al. | |
| 6,477,960 | B2 * | 11/2002 | Theurer et al. | 104/9 |
| 6,619,405 | B2 * | 9/2003 | Theurer et al. | 171/16 |
| 6,637,133 | B2 * | 10/2003 | Theurer et al. | 37/104 |

FOREIGN PATENT DOCUMENTS

| | | | |
|---|---|---|---|
| DE | 2 714 055 | A1 | 12/1977 |
| DE | 2714055 | A1 | 12/1977 |
| EP | 1 179 635 | A2 | 2/2002 |
| WO | 2009/092896 | A2 | 7/2009 |

* cited by examiner

*Primary Examiner* — Mark Le
(74) *Attorney, Agent, or Firm* — Laurence A. Greenberg; Werner H. Stemer; Ralph E. Locher

(57) ABSTRACT

A machine for renovating a track includes the following: a transverse chain segment of an excavating chain is designed shorter than a crosstie length of new crossties. A ballast plow is disposed relative to a longitudinal machine axis between the transverse chain segment of the excavating chain and the device for placing the new crossties. A width—extending normal to the longitudinal machine axis—of the ballast plow is designed greater than the crosstie length of the new crossties.

6 Claims, 2 Drawing Sheets

MACHINE AND METHOD FOR RENOVATING A TRACK

BACKGROUND OF THE INVENTION

Field of the Invention

The invention relates to a machine for renovating a track composed of rails and crossties and resting on a ballast bed. The machine includes devices for removing old crossties and placing new crossties, an endless excavating chain with a transverse chain segment provided for taking up ballast, and a ballast plow designed for creating a graded support surface for the new crossties. The invention also relates to a method.

A machine of this type is known from U.S. Pat. No. 5,357,867 or U.S. Pat. No. 6,474,241.

BRIEF SUMMARY OF THE INVENTION

It is the object of the present invention to provide a machine and a method of the specified kind with which it is possible to also accomplish without problems especially a vertical lowering of the new track.

According to the invention, this object is achieved with a machine and a method of the specified type by way of the features cited in the claims.

The invention is based on the idea of transporting away, by means of the excavating chain, only a part of the ballast which has to be removed for a lowering of the track. In a simple manner, the residual ballast remaining in the peripheral areas of the track bed is merely displaced by the ballast plow into the shoulder or flank region of the track bed, keeping the transport path very short. This provides the advantage that the excavating chain as well as an adjoining transport path can be of smaller dimensions. The said residual ballast can be used for ballasting the crosstie ends of the newly-laid crossties, requiring only a minimal transport path.

Additional advantages of the invention become apparent from the dependent claims and the drawing description.

BRIEF DESCRIPTION OF THE SEVERAL VIEWS OF THE DRAWING

The invention will be described in more detail below with reference to an embodiment represented in the drawing in which.

DESCRIPTION OF THE INVENTION

Figure 1:
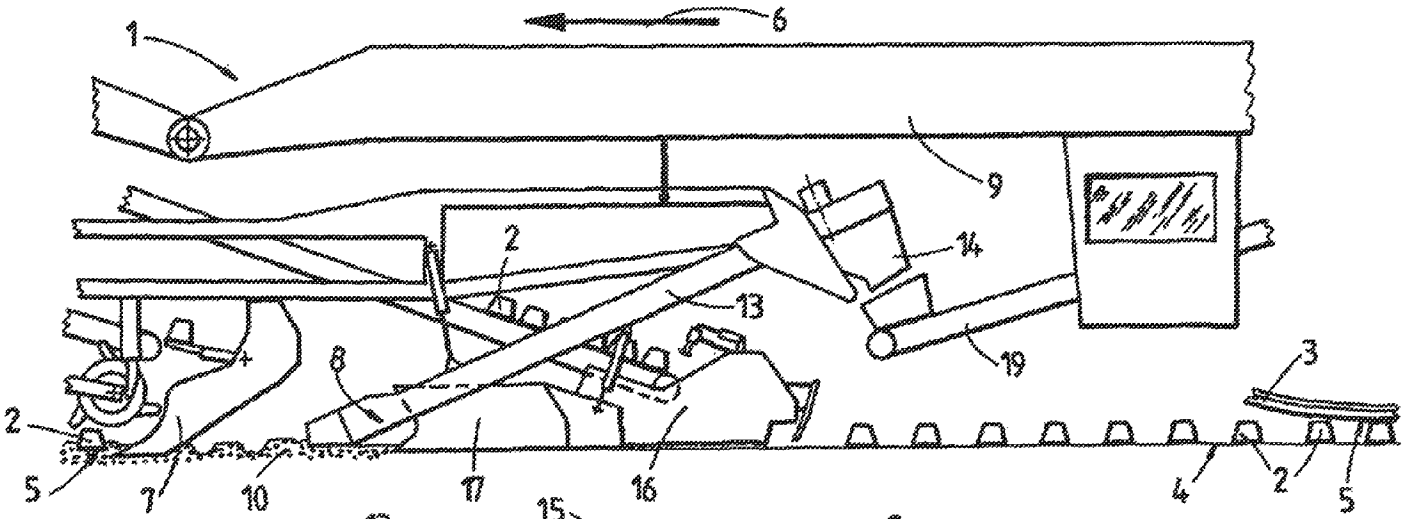
FIG. 1 is a side view of a part of a machine for track renovation, with an excavating chain and a ballast plow shown in the working position.
Figure 2:
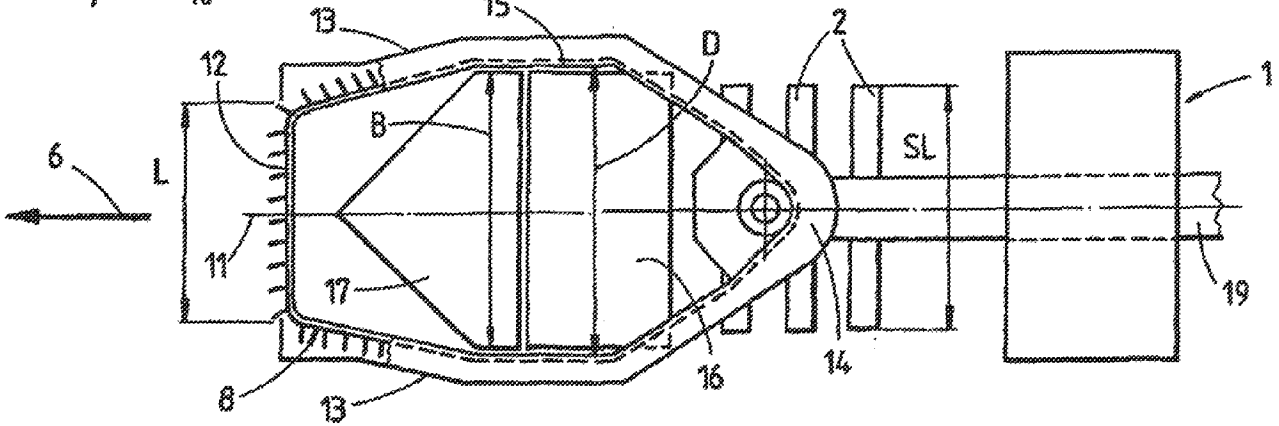
FIG. 2 is a simplified top view of the machine, and FIGS. 3 to 6 each are schematic cross-sections of a track bed.

A machine 1, of which only a small section is shown in FIGS. 1 and 2, serves for renovating a track 5, composed of crossties 2 and rails 3 and resting on a track bed 4, in the course of a continuous work run. During this, a front part of the machine 1 still travels on the old track 5 while a rear section is already supported on the newly-laid track 5.

A front device 7—with respect to a working direction 6—serves for picking up the old crossties 2 which are stored on wagons via suitable transport means.

To the rear of the said pick-up device 7, an endless excavating chain 8 adjustable by drives is connected to a machine frame 9. This excavating chain 8 is composed of a transverse chain segment 12, provided for taking up ballast 10 and extending perpendicularly to a longitudinal machine axis 11 (see FIG. 2), two chain channels 13, and a discharge end 14.

As can be seen in FIG. 2, the transverse chain segment 12 is designed—with regard to its length L—about 20% shorter than a crosstie length (SL) of the new crossties 2. In a segment 15 located approximately centrally between the discharge end 14 and the transverse chain segment 12, the two chain channels 13 of the excavating chain 8 are spaced from one another at a greater distance (D) than in a segment adjoining the transverse chain segment 12. Thus, the excavating chain 8 has a total of seven deflection points.

Figure 4:
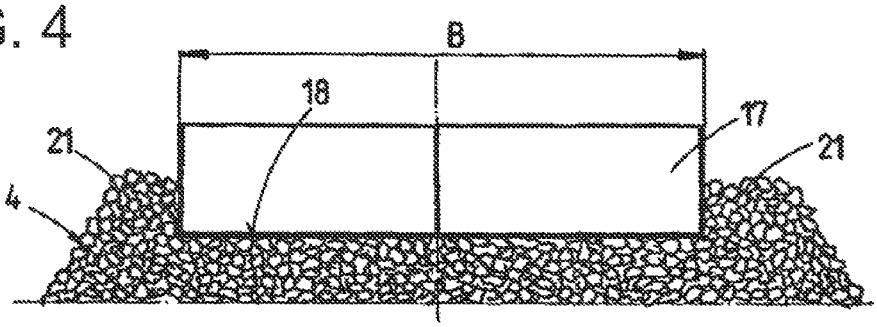

A V-shaped ballast plow 17 is disposed—with regard to the longitudinal machine axis 11—between the transverse chain segment 12 and a device 16 for placing new crossties 2. A width B—extending perpendicularly to the longitudinal machine axis 11—of the ballast plow 17 is designed greater than the crosstie length (SL) of the new crossties 2 (see FIGS. 4, 5).

As visible in FIG. 2, the ballast plow 17 and the device 16 are positioned—with regard to the longitudinal machine axis 11—between the transverse chain segment 12 and the discharge end 14, designed for discharging the picked-up ballast 10, of the excavating chain 8.

Figure 3:
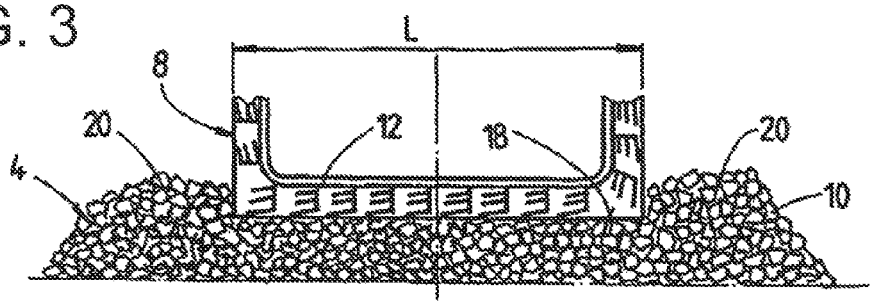

The operating mode of the machine 1 will now be described in more detail: As can be seen particularly in FIG. 3, only a part of the ballast 10 to be removed for forming a support surface 18 for placing crossties is picked up by the transverse chain segment 12 of the excavating chain 8. This ballast 10 is conveyed via a transport path 19 (FIG. 1) to the rear end of the machine in order to be discharged—after optional cleaning—upon the new crossties 2 for ballasting the same.

As a result of the reduced picking-up of ballast by the excavating chain 8, there remain two ballast banks 20 spaced from one another in a transverse direction of the machine. These are displaced or shifted in each case by the ballast plow 17, following immediately behind in the working direction 6, into an adjoining shoulder region 21 of the track bed 4 for creating the final crosstie support surface 18 (see FIGS. 4, 5).

Figure 5:
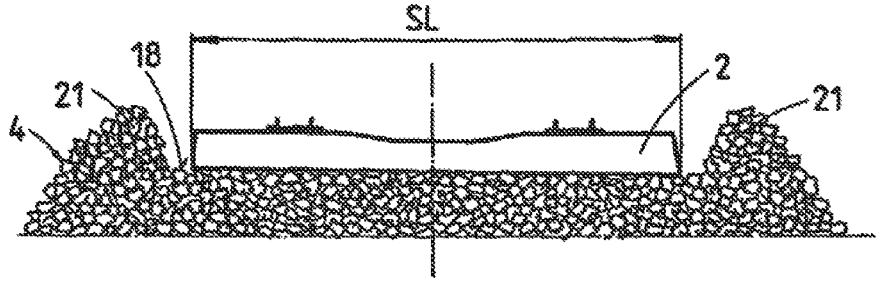
Figure 6:
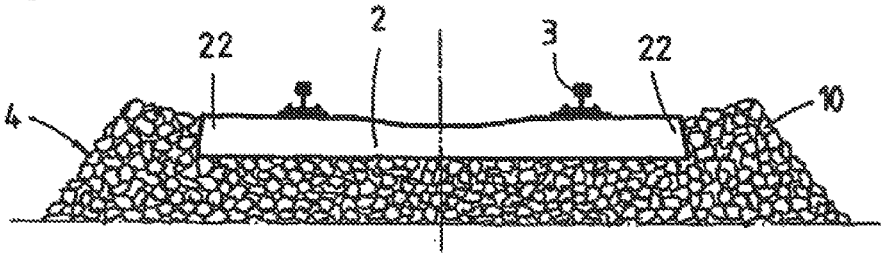

As visible in FIG. 5, the new crossties 2 can be placed by means of the device 16 upon the crosstie support surface 18 of the track bed 4 without problems. In the rear end region of the machine 1, the ballast 10 of the two afore-mentioned ballast banks 20 intermediately stored in the shoulder region 21 can already be shifted back for ballasting crosstie ends 22 of the newly-laid crossties 2 (see FIG. 6).

Alternatively, it would naturally also be possible—particularly in the case of lowering the track to a greater extent—to merely create a temporary support surface 18 by means of the excavating chain 8. The final support surface 18, disposed lower, can be obtained by positioning the ballast plow 17 at a correspondingly lower level. In this manner, overloading of the excavating chain 8 can be avoided. It is also advantageous to execute, in parallel with the grading work, also a compaction of the track bed 4 by means of the ballast plow 17.

The invention claimed is:

1. A machine for renovating a track composed of rails and crossties and resting on a ballast bed, the machine comprising:

devices for removing old crossties and placing new crossties, the new crossties having a given crosstie length;

an endless excavating chain with a transverse chain segment provided for taking up ballast, said transverse chain segment having a given length that is shorter than said given crosstie length of the new crossties; and a ballast plow configured for creating a graded support surface for placement of the new crossties, said ballast plow being disposed, with respect to a longitudinal machine axis, between said transverse chain segment of said excavating chain and said device for placing the new crossties, and said ballast plow having a width, extending perpendicularly to the longitudinal machine axis, greater than said given crosstie length of the new crossties.

2. The machine according to claim 1, wherein said length of said transverse chain segment is at least 20% shorter than said given crosstie length of the new crossties.

3. The machine according to claim 1, wherein said ballast plow and said device for placing the new crossties are positioned, relative to the longitudinal machine axis, between said transverse chain segment and a discharge end of said excavating chain for discharging picked-up ballast.

4. The machine according to claim 3, wherein, in a segment formed approximately centrally between said discharge end and the transverse chain segment, two chain channels of said excavating chain connecting said transverse chain segment to said discharge end are spaced at a greater distance from one another than in a segment adjoining said transverse chain segment.

5. A method for renovating a track with a machine having an excavating chain and a ballast plow, the method which comprises:

removing old crossties and thereby exposing a ballast of a track bed underneath the crossties;

partially picking up the ballast exposed by the removal of the old crossties with the excavating chain while grading a remaining ballast, to thereby create a support surface for placing new crossties;

thereby picking up only a portion of the ballast to be removed for creating the support surface with the excavating chain, such that two ballast banks remain, spaced from one another in a transverse direction of the machine; and shifting the ballast banks with a ballast plow into adjoining shoulder regions of the track bed for creating a final support surface.

6. The method according to claim 5, wherein the shifting step comprises shifting the ballast into the shoulder region by displacing the ballast in each case in the direction of crosstie ends of the new crossties.

* * * * *